US006460696B1

(12) United States Patent
Meyer

(10) Patent No.: US 6,460,696 B1
(45) Date of Patent: Oct. 8, 2002

(54) CREDIT CARD HOLDER WITH CARDS FORMING ENCLOSING SURFACES

(75) Inventor: Richard J. Meyer, P.O. Box 3046, Newport Beach, CA (US) 92660

(73) Assignee: Richard J. Meyer, Newport Beach, CA (US)

( * ) Notice: Subject to any disclaimer, the term of this patent is extended or adjusted under 35 U.S.C. 154(b) by 0 days.

(21) Appl. No.: 09/641,447

(22) Filed: Aug. 17, 2000

(51) Int. Cl.[7] ..... A45C 11/00; B65D 85/00
(52) U.S. Cl. ..... 206/37.1; 206/38; 206/449
(58) Field of Search ..... 206/37, 37.4, 38, 206/38.1, 39, 39.5, 39.3, 449; 150/147–149; 220/4.01

(56) References Cited

U.S. PATENT DOCUMENTS 4,286,641 A * 9/1981 Watson ..... 206/37
4,402,398 A * 9/1983 Smoczynski ..... 229/92.9
5,038,926 A * 8/1991 Van der Toorn ..... 206/39

FOREIGN PATENT DOCUMENTS

EP 0340048 * 11/1989 ..... A45C/11/32
GB 2249259 * 5/1992 ..... 206/39

* cited by examiner

*Primary Examiner*—Bryon P. Gehman
(74) *Attorney, Agent, or Firm*—Donald W. Meeker

(57) ABSTRACT

Top and bottom frame supports are spaced apart and secured together by central end posts. Downwardly opening grooves along the arcuate edges of the top frame support align with upwardly opening grooves along the arcuate edges of the bottom frame support to form mating tracks into which credit cards are inserted. The credit cards bend into the shape of the grooves and overlap with two cards on each side to form side enclosure surfaces which enclose a storage space between the cards on each side and the top and bottom frame supports for storing money and other valuables. A holder with a key, pen, knife, or other device may be inserted in a notch in the top frame support. Alternately the framed supports may be hinged together at one end to form a hinged clamshell-type container.

17 Claims, 7 Drawing Sheets

CREDIT CARD HOLDER WITH CARDS FORMING ENCLOSING SURFACES

DESCRIPTION

Background of the Invention

1. Field of the Invention

The present invention relates to wallets and card holders and in particular to a credit card holder and wallet in which the cards themselves form the outer enclosing surfaces for containing money or other items therein.

2. Description of the Prior Art

Most prior art credit card holders and wallets have outer retaining surfaces formed of leather, plastic, or other material for containing the money and credit cards, licenses, and other valuables inside. Most of the material forming the holder or wallet is used for the outer retaining surfaces. In some cases this material takes up considerable space and adds substantially to the bulge in the clothes if carrying the holder or wallet in a pocket or takes up considerable space in a purse or pouch.

Most prior art credit card holders and wallets are box shaped with flat sides which don't necessarily conform to the shape of a person's leg if they are carried in a pocket or don't conform to often curved shaped purses or pouches.

Often the cards contained are not visible from the outside if the outer retaining surfaces are opaque, as in the case of leather.

U.S. Pat. No. 5,358,019, issued Oct. 25, 1994 and U.S. Pat. No. 5,520,230, issued May 28, 1996, both to Sumner, provide a credit card holder and money clip combined. The credit card holding side has two side channels for holding credit cards stacked between the side channels. The Sumner invention has an additional central plate for support of the cards and the money, so that the cards are not self supporting and there is no space between the cards. The second patent adds an additional configuration with the cards oriented transversely to the money.

U.S. Pat. No. 5,417,328, issued May 23, 1995 to Ritter, shows a case for carrying a card having a magnetic strip and chip. Two parallel opposing guide strips receive the card, but a base between the guide strips also supports and protects the card along with a web across a portion of the top of the card. Cleaning elements are provided to clean the magnetic strip on the card.

U.S. Pat. No. 5,038,926, issued Aug. 13, 1991 to van der Toorn, claims a credit card holder having a rectangular frame with a central opening to receive the credit card and with protruding elements into the open portion of the frame to retain the card in the frame. Pivoting top and bottom lids further serve to cover and protect the card. Multiple cards may be stored in the holder. No provision is made for creating a space between cards to hold money, etc.

U.S. Pat. No. 4,450,955, issued May 29, 1984 to Featherston, describes a credit card holder having two opposing parallel side lips to secure the card. A base is provided between the two side lips to protect the card and a protrusion is provided to prevent the magnetic strip on the card from contacting the base.

U.S. Pat. No. 4,518,080, issued May 21, 1985 to Ohlson, discloses an ID card holder a with opposing parallel side slots for retaining the card and a base between the slots with protrusions in the base to bend the card for easier insertion and removal of the card relative to stops at the ends of the card holder.

None of the prior art patents use the credit cards as the sole side supports containing other items therebetween.

SUMMARY OF THE INVENTION

Credit cards are made of sturdy slightly flexible plastic. They are waterproof and resistant to wear and tear, thereby forming ideal protective surfaces.

A support frame structure with pairs of diverging tracks or grooves on two opposing sides of the support frame forms the tracks within which credit cards are inserted and held to form a pair of opposing side walls with a storage space in between the opposing walls to contain business cards, money or other valuables, the support frame enclosing the space on the top and bottom.

The primary object of the present invention is to provide a credit card holder and wallet in which the credit cards themselves form the containing surfaces to hold money and other valuables, thereby forming water-resistant sturdy protective surfaces.

Another object of the present invention is to form a credit card holder and wallet which has a concave shape on one side to rest comfortably against and conform to the curved surface of a user's leg with the invention in the user's pocket.

An additional object of the present invention is to provide an optional opening in the support frame and a tight friction fit holder inserted in the opening for storing a key, pen, knife, or other utility device normally carried in the pocket or purse.

A further object of the present invention is to provide support frames of varying shapes to suit particular needs.

An added object of the present invention is to provide a hinged support frame that swings open to access the contents.

In brief, a support frame of injection molded plastic, extruded plastic, metal, or other material having a somewhat rigid structural integrity is formed with a top and bottom track portions separated by the length of a credit card and interconnected at one or both ends by a spacer. The support frame is narrow at both ends and widens out in the middle. A groove is formed along each edge of the top and bottom track portions so that the top track portion grooves face and align with the bottom track portion grooves so that the grooves form pairs of opposing tracks along the edges of the support frame. Credit cards slide into the grooves in an overlapping array to enclose the sides of the invention and form a storage space between the cards on opposing sides with the support frame enclosing the top and bottom.

Money, credit cards, business cards, identification, or other items normally contained in wallets or credit card holders may be carried in the storage space.

In one embodiment, straight post-like elements form the spacers at both ends of the invention and the contents of the invention are accessed by sliding one of the credit cards aside to create an access opening.

In another embodiment, a spacer in the form of a hinge connects the top and bottom track portions of the support frame at only one end, so that the side may be pivoted open to access the interior storage space.

In addition, a small opening or notch may be formed in one of the track portions of the support frame and a holder with a key, pen, knife or other utility device normally carried in the pocket or purse, inserted in the small opening or notch for carrying the utility device therein.

An advantage of the present invention is that it creates a credit card holder and wallet which utilizes a minimum of material in its fabrication.

Another advantage of the present invention is that it allows the credit cards to be readily visible and accessible.

An additional advantage of the present invention is that it fits comfortably and conveniently in a pocket or purse.

These and other features, objects and advantages will be understood or apparent to those of ordinary skill in the art from the following detailed description of the preferred embodiment as illustrated in the various drawing figures.

DETAILED DESCRIPTION OF THE PREFERRED EMBODIMENT

Figure 1:
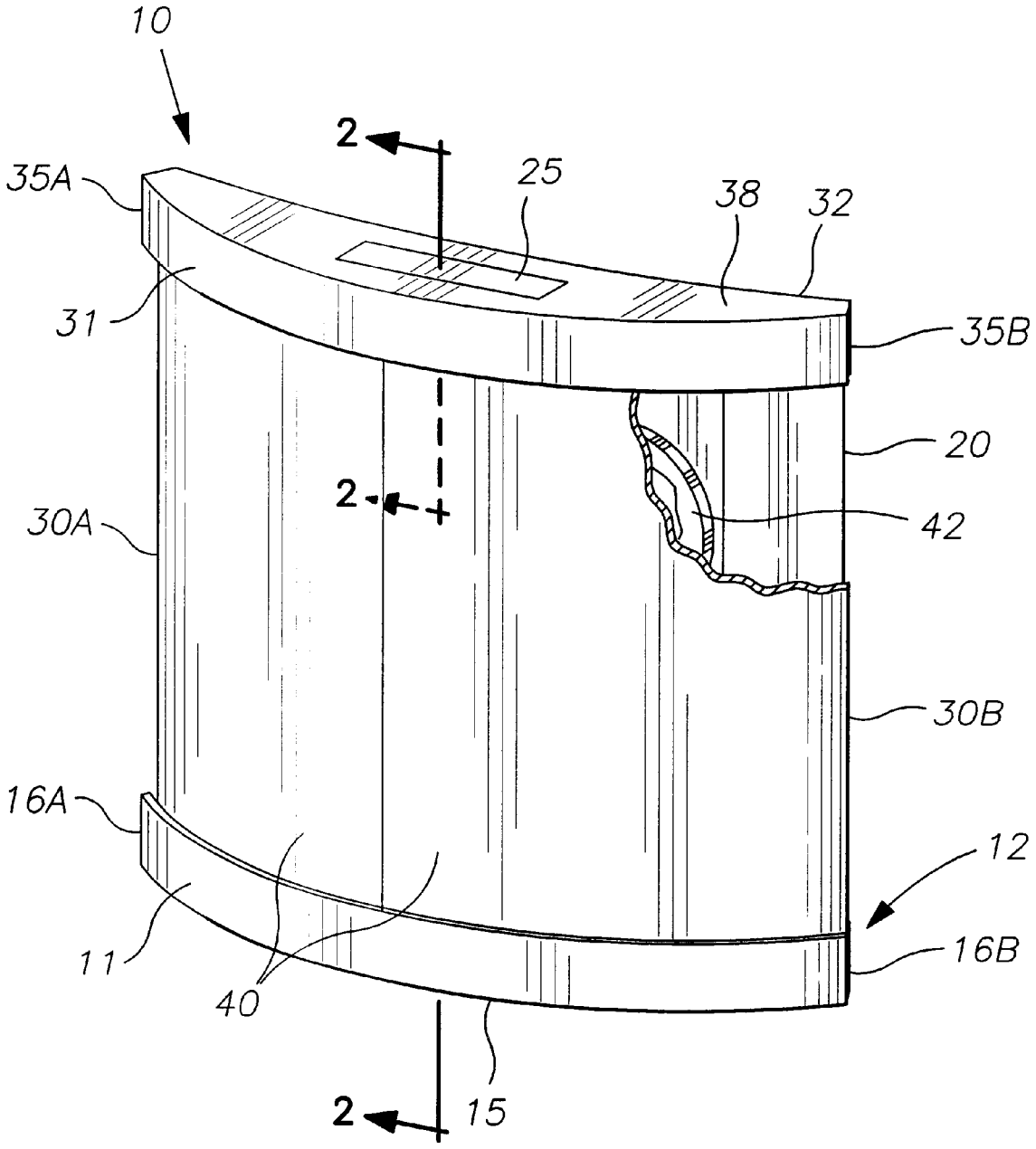
FIG. 1 is a perspective view showing the preferred embodiment of the invention with one concave side and including a key storage space.
Figure 2:
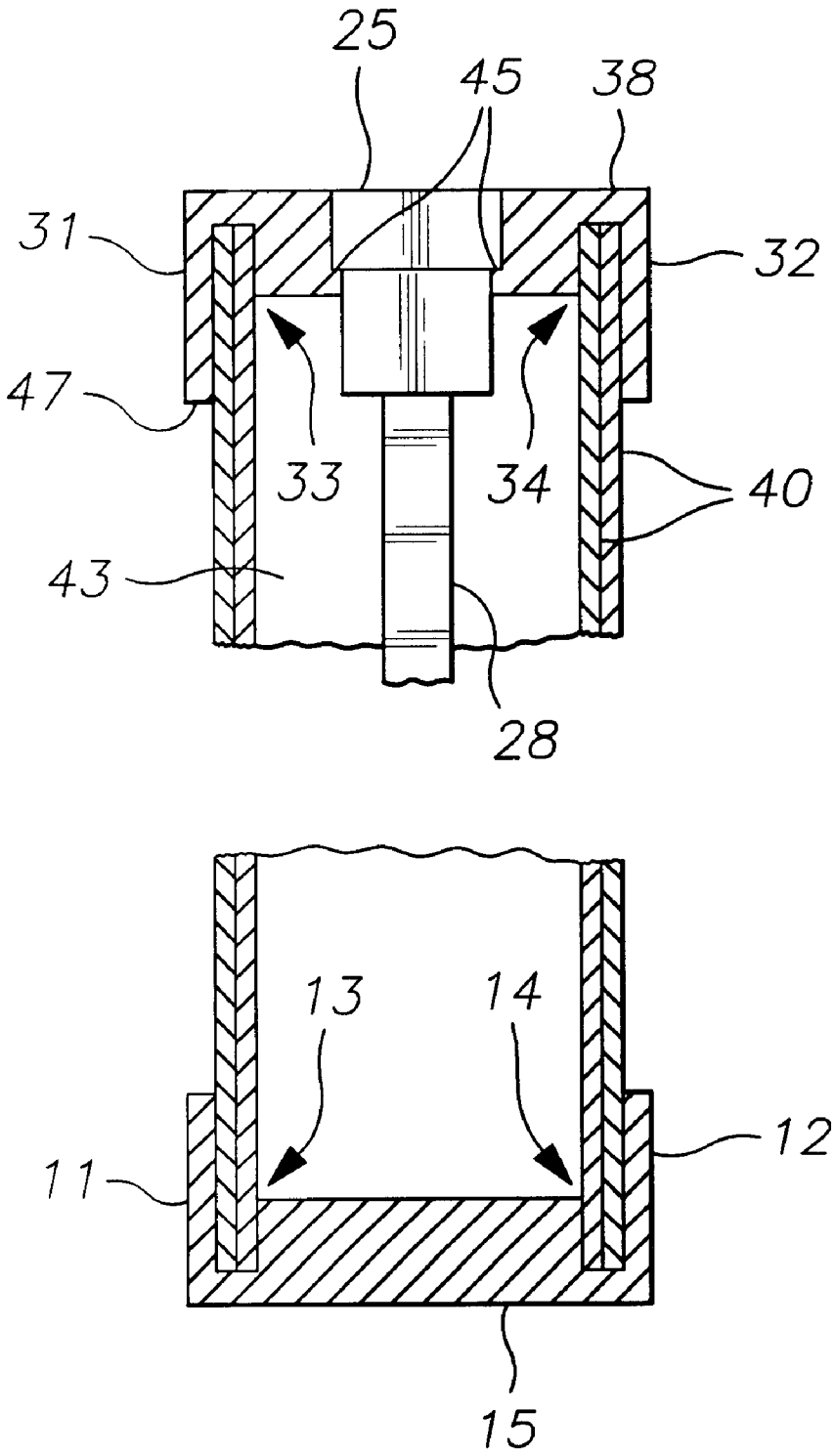
FIG. 2 is a partial cross-sectional view taken through 2—2 of FIG. 1 showing how the credit cards fit into the card holding grooves and how the key holder fits into the key holder opening.
Figure 3:
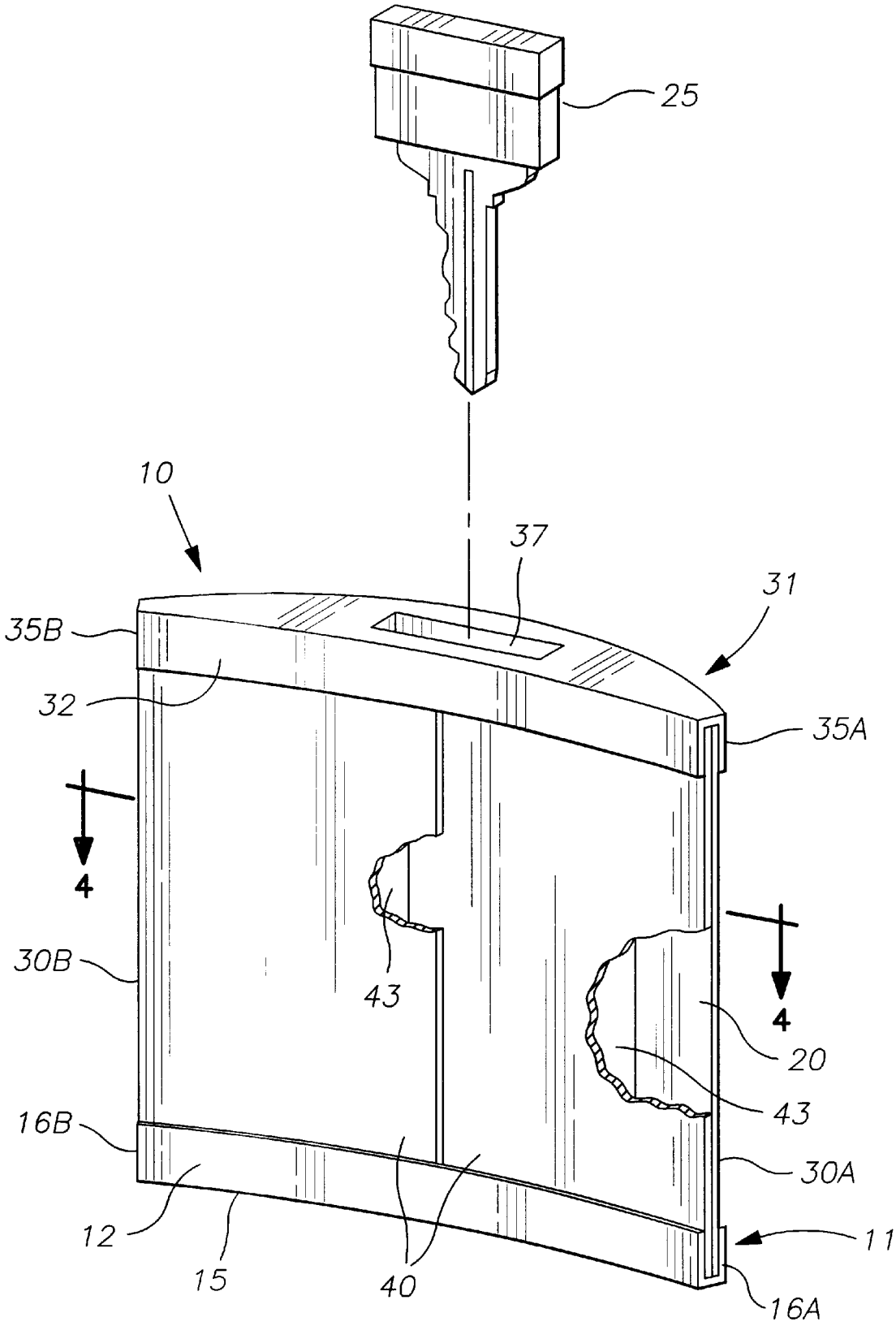
FIG. 3 is a perspective view in partial section showing the concave side of the invention and the key and keyholder aligned for insertion in the key holder opening in the support frame.
Figure 4:
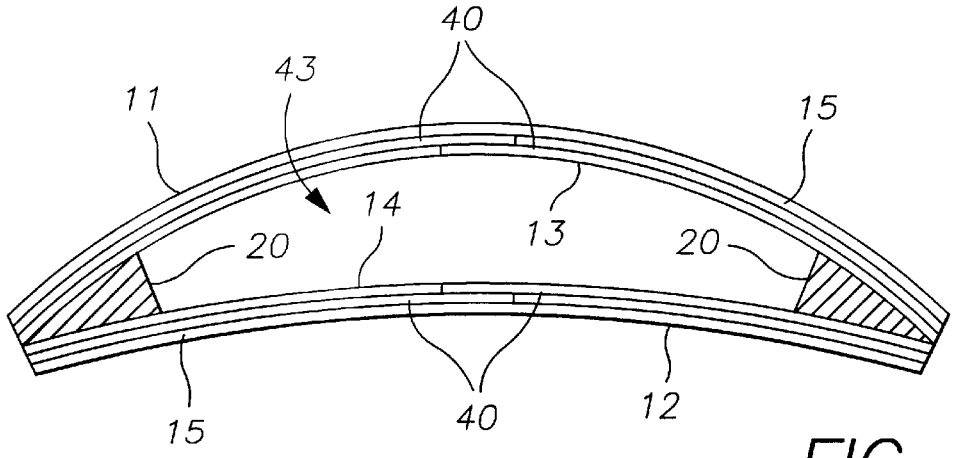
FIG. 4 is a cross-sectional view taken through 4—4 of FIG. 3 of the preferred embodiment of the invention showing four cards inserted on each side of the support frame.

In FIGS. 1–3, a credit card holder and wallet device 10 has at least one enclosing side of the device formed by at least one credit card 40. An enclosure means, comprising an upper support frame 38 and a lower support frame 15 connected by at least one rigid support 20, is adapted for containing money 42 and other items normally carried in a pocket and purse having a portion of the enclosure means, such as grooves 13, 14, 33, and 34, adapted to receive at least one credit card 40 removably inserted therein, slidably between the grooves, so that the at least one credit card forms a structural element in the enclosure serving as a removable enclosing wall to retain the money and other items contained therein.

In the preferred embodiment of FIGS. 1–4, 7, and 8 a credit card holder and wallet device 10 has the enclosing sides of the device formed by a series of credit cards 40. A support frame has an elongated solid top frame surface 38 and an elongated solid bottom frame surface 15 both formed of a solid material such as plastic or metal and both having a similar elongated configuration. The top frame surface 38 has a top groove 33 and 34 opening downwardly along the length of each long side edge and the bottom frame surface 15 has an opposing mating bottom groove 13 and 14 opening upwardly along the length of each long side edge forming an opposing paired set of grooves on each long side. The grooves are at least equal in width to the thickness of a credit card, and preferably equal in width to the thickness of two credit cards in a central portion where the credit cards 40 overlap (as in FIG. 2). At each end 35A and 35B of the top surface 38 and at each end 16A and 16B of the bottom surface 15 the slots narrow to a single card width and the slots on each side meet at the ends to position the credit cards 40 on the two opposing sides together so that the edges of the credit cards 30A and 30B close each of the side edges of the device (as seen in FIG. 3). The credit cards 40 slide in and out of the end edges in the slots.

The top and bottom surfaces 38 and 15 are spaced apart a distance so that each of the opposing paired set of grooves 33–13 and 34–14 is capable of receiving at least one credit card 40 along each long edge slidably inserted in and retained within the grooves. Preferably two credit cards on each side. The credit cards 40 form enclosing surfaces on each side of the device creating an enclosed storage space 43 for containing money 42 or other valuables between the cards 40 on each side and the top and bottom frame surfaces 38 and 15.

A top flange 31 and 32 extends downwardly from each long edge of the top support frame 38 and a bottom flange 11 and 12 extends upwardly from each long edge of the bottom support frame 15, each of the flanges positioned outside of and immediately adjacent to each groove so that the credit cards are further retained in place by each of the flanges.

A rigid support, such as triangular cross-section post 20, connects the top and bottom frame surfaces at least at one end, and at both ends in the preferred embodiment 10 of FIGS. 1–4, 7, and 8. The thin pointed acute triangular cross-section post 20 is positioned between the grooves on opposite sides of the device adjacent to each end of the device and the grooves on opposite sides meet at the ends of the device so that the credit cards 40 meet at the ends 30A to close the ends of the device as seen in FIG. 3.

Each groove may be the width of a single credit card adjacent to each end and gradually expand in width to the width of two credit cards at the middle of each groove so that each groove accommodates two credit cards in each groove which credit cards overlap in the middle of the groove or each groove may be the width of two credit cards.

Figure 9:
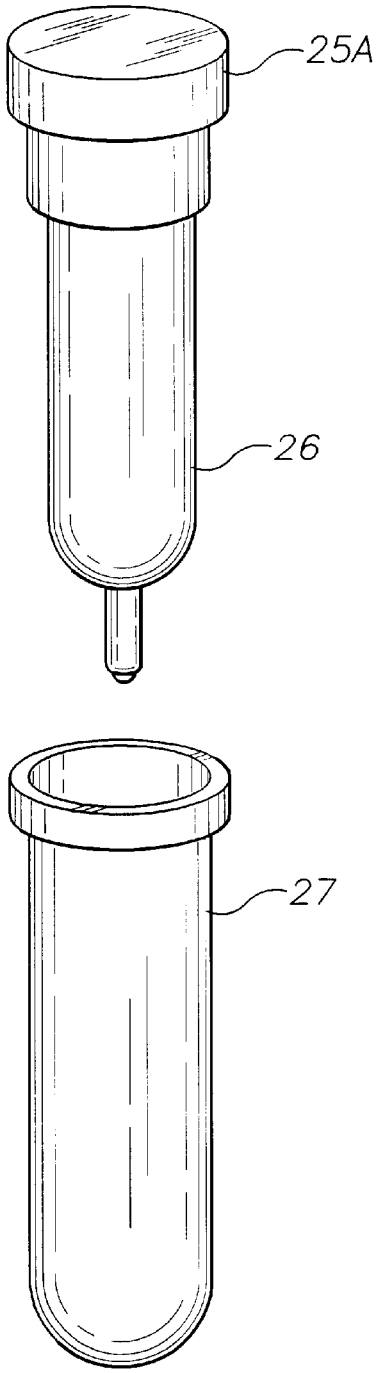
FIG. 9 is a perspective view showing an insertable pen holder and pen.
Figure 10:
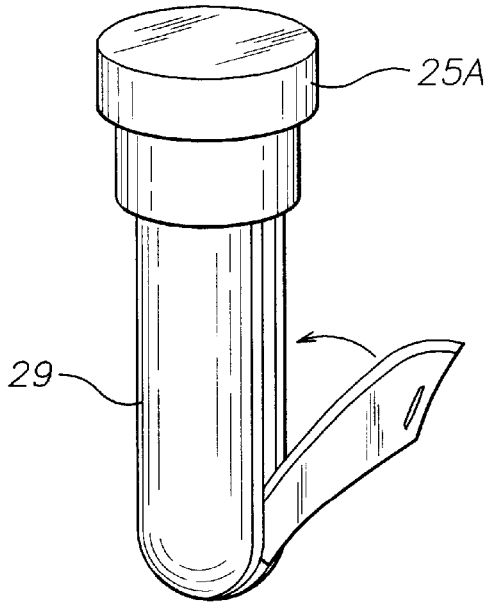
FIG. 10 is a perspective view showing an insertable knife holder and knife.

In FIGS. 1–3 at least one of the support frames, in this case the top support frame 38 is provided with a notch 37 therein and the device further comprises a holder means 25 configured so that it fits in the notch and seals the notch with a tight friction fit, the holder means configured for holding a utility device, such as a key 28 (FIGS. 1–3), pen 26 with cap 27 (FIG. 9), knife 29 (FIG. 10) or other device normally carried in a pocket, for insertion into and removal from the notch. The key holder 25 is configured in a rectangular stepped shape so that it fits in the rectangular stepped notch 37 with shoulders 45 and seals the notch with a tight friction fit, an enlarged top of the key holder resting on shoulders 45 in the notch (as seen in FIG. 2). A circular holder 25A (shown dashed in FIG. 6C) could be inserted in a similar fashion to the key holder 25 (FIG. 3) for holding the pen 26 and cap 27 of FIG. 9, the knife 29 of FIG. 10 or other object and inserting it removably in the top support frame 38H.

Figure 8:
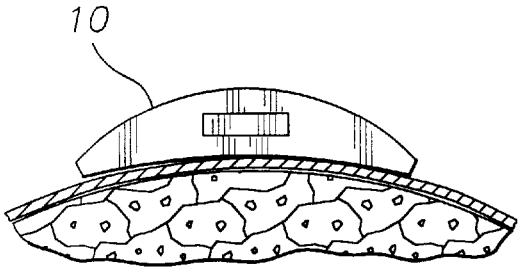
FIG. 8 is a cross-sectional view taken through 8—8 of FIG. 7 showing the preferred embodiment of the invention fitting with its concave side conforming to the contour of the user's leg.

In the preferred embodiment of FIGS. 1–4, 7, and 8, the long side edges of the top and bottom support frames on at least one side are arcuate in shape to conform to an external container. In FIG. 8 the long side edges of the top and bottom support frames on at least one side are concave in shape to conform to a shape of a pocket against a leg of a user. The long side edges of the top and bottom support frames on the other side are convex and of a shorter radius of curvature than the concave side so that a storage space 43 is created between the two sides.

Figure 5A:
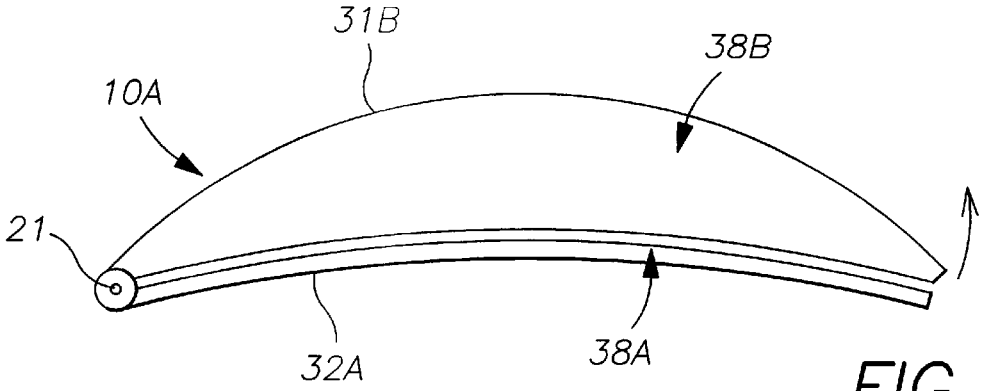
FIG. 5A is a top plan view of an alternate embodiment of the invention with one hinged end, a concave side and a convex side.
Figure 5B:
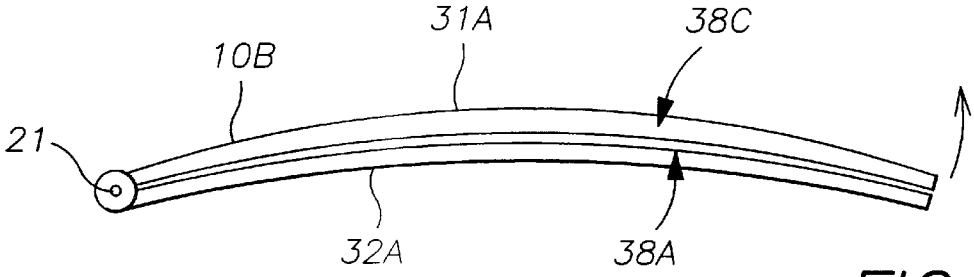
FIG. 5B is a top plan view of an alternate embodiment of the invention with one hinged end, a concave side and a convex side on a smaller radius of curvature creating a thin credit card holder and wallet with a minimum of interior storage space.
Figure 5C:
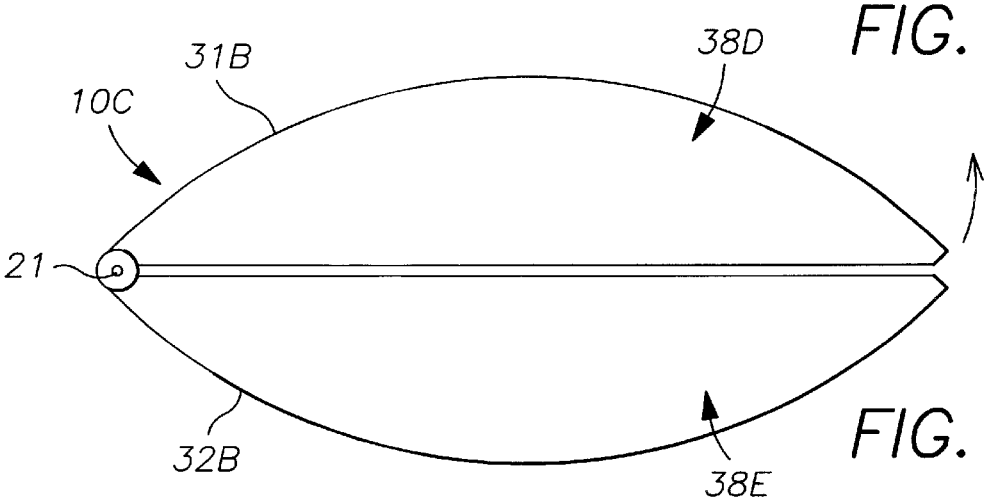
FIG. 5C is a top plan view of an alternate embodiment of the invention with one hinged end and two convex sides for maximum interior space.

In FIGS. 5A, 5B, and 5C, alternate embodiments 10A, 10B, and 10C of the invention have the top and bottom support frames each formed in two pieces 38A and 38B, 38C and 38A, and 38D and 38E, and the rigid support comprising a hinge 21 between the top and bottom support frames at one end, so that one of the two pieces on each support frame pivots relative to the other in a clamshell fashion. The embodiment 10A of FIG. 5A is shaped in a similar fashion to the preferred embodiment shown in FIG. 4. The embodiment 10B of FIG. 5B has the long side edge 31A of one of the halves of the top support frame 38C, defined by flange edge 31A, convex in shape, and the long side edge 32A of the other half of the support frame 38A, defined by flange edge 32A, concave in shape and having the same radius of curvature of the other edge, so that a long narrow storage space would be created inside. In FIG. 5C in embodiment 10C of the invention has the long side edges, defined by flange edges 31B and 32B of both halves of the top support frame 38D and 38C and the bottom support frame (not shown) convex on both sides creating a storage space therebetween which is larger in the middle of the device.

Figure 6A:
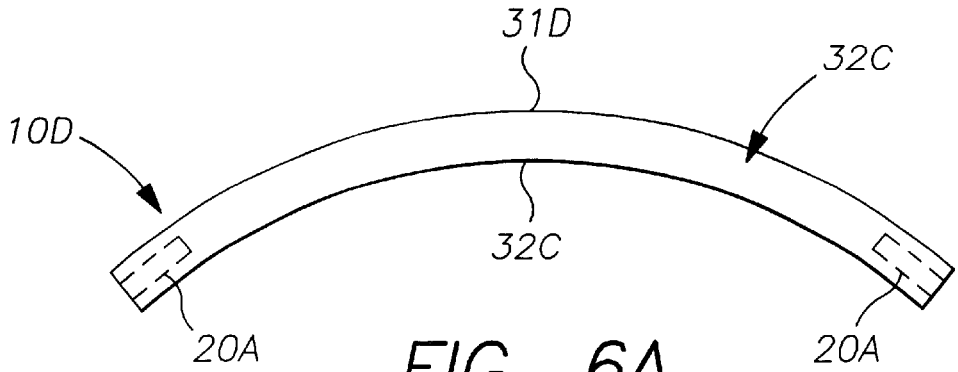
FIG. 6A is a top plan view of another alternate embodiment of the invention having a concave and a convex side having a similar radius of curvature creating a thin credit card holder and wallet with a minimum internal storage space.

In FIG. 6A an alternate embodiment 10D of the invention has one of the long side edges of the top support frame 38F and bottom support frame (not shown), defined by flange edge 31D, convex in shape and the other of the long side edges of the support frame, defined by flange edge 32C, concave in shape and having the same radius of curvature of the other edge, so that a long narrow storage space would be created inside and the end posts 20A (shown dashed) would be short and rectangular in cross-section.

Figure 6B:
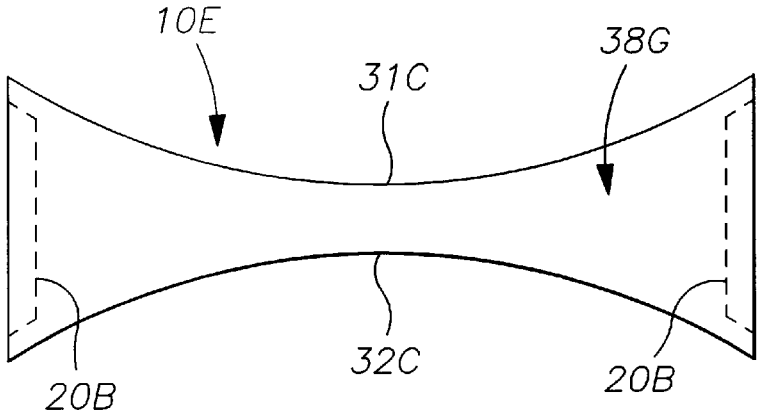
FIG. 6B is a top plan view of another alternate embodiment of the invention having two concave sides with large interior storage spaces at each end.

In FIG. 6B another alternate embodiment 10E of the invention has the long side edges of the top support frame 38G defined by flanges edges 31C and 32C, and bottom support frame (not shown), concave on both sides creating a storage space therebetween which is larger at each end of the device. The end posts 20B (shown dashed) would be long and narrow extending along the long ends.

Figure 6C:
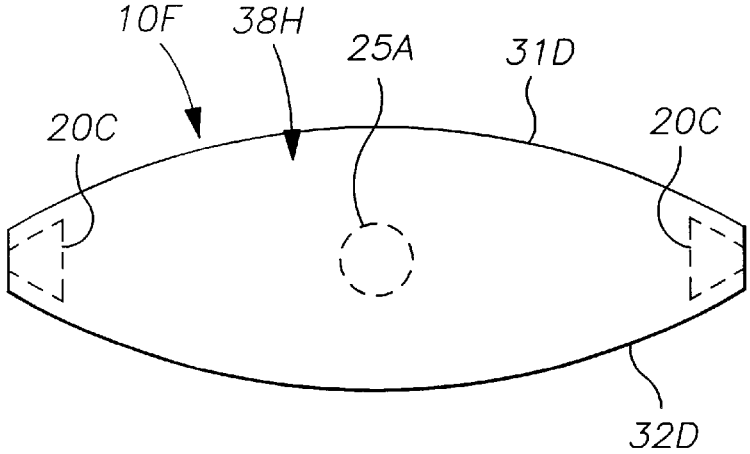
FIG. 6C is a top plan view of another alternate embodiment of the invention having two convex surfaces for a large central interior storage space.
Figure 7:
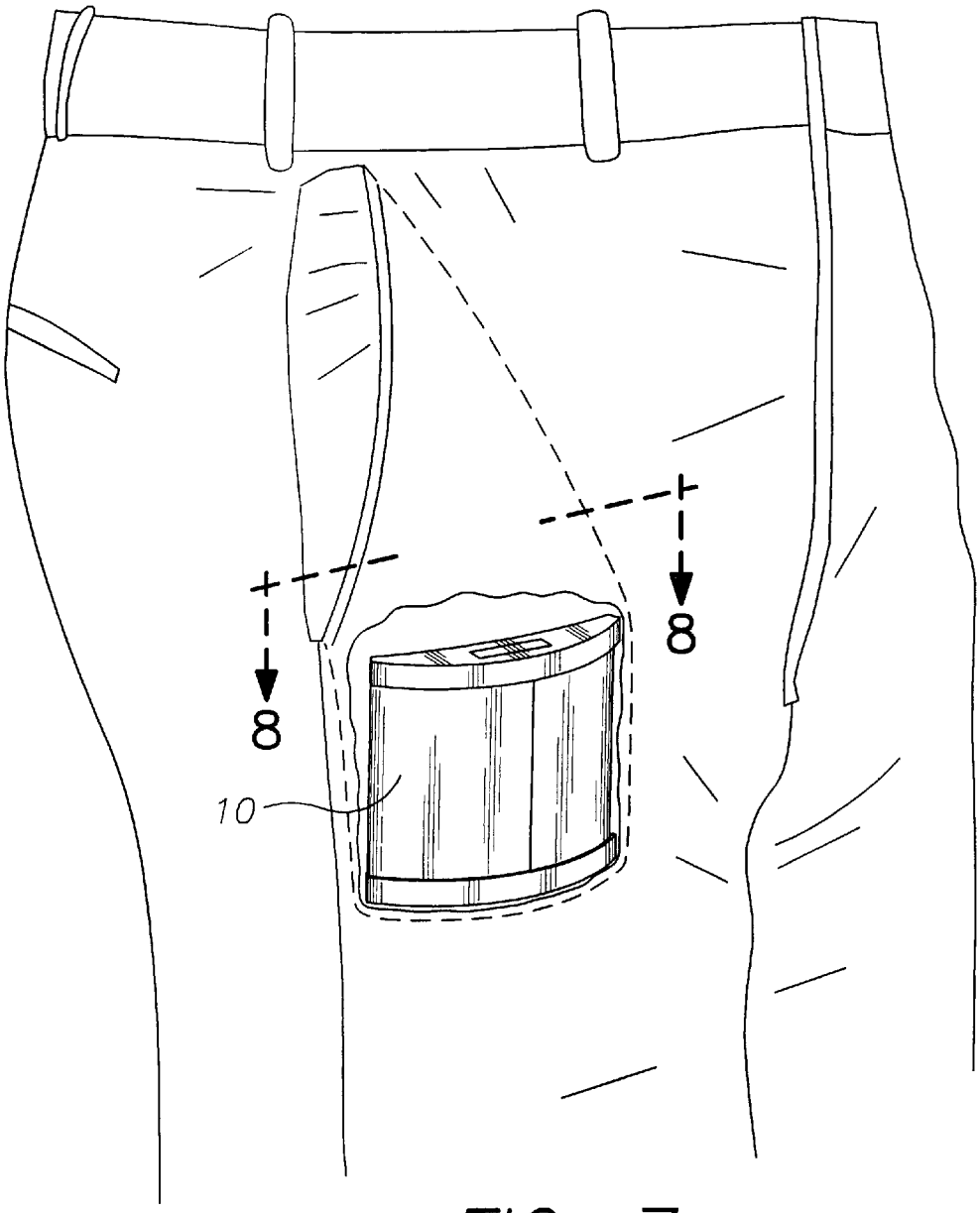
FIG. 7 is a partial perspective view in partial section of a user with the preferred embodiment of the invention in the user's pocket.

In FIG. 6C another alternate embodiment 10F of the invention has the long side edges of the top support frame 38H, defined by flange edges 31D and 32D, and bottom support frame (not shown) convex on both sides creating a storage space therebetween which is larger in the middle of the device. The end posts 20C are truncated pyramid shapes with slightly wider ends than the preferred embodiment. A circular holder 25A (shown dashed) could be inserted in a similar fashion to the key holder 25 (FIG. 3) for holding a pen, knife or other object and inserting it removably in the top support frame 38H.

The device may be fabricated by injection molding plastic parts or casting metal parts and assembling the parts.

Although the present invention has been described in terms of the presently preferred embodiment, it is to be understood that such disclosure is purely illustrative and is not to be interpreted as limiting. Consequently, without departing from the spirit and scope of the invention, various alterations, modifications, and/or alternative applications of the invention will, no doubt, be suggested to those skilled in the art after having read the preceding disclosure. Accordingly, it is intended that the following claims be interpreted as encompassing all alterations, modifications, or alternative applications as fall within the true spirit and scope of the invention.

What is claimed is:

1. A credit card holder and wallet device having at least one enclosing side of the device formed by at least one credit card, wherein the device comprises:

an enclosure means adapted for containing money and other items normally carried in a pocket and purse having a portion of the enclosure means adapted to receive at least one credit card removably inserted therein so that the at least one credit card forms a structural element in the enclosure means serving as a removable enclosing wall to retain the money and other items contained therein;

wherein the enclosure means comprises a top support frame and a bottom support frame and at least one rigid support connecting the support frames and the portion of the enclosure means adapted to receive the at least one credit card removably therein comprises opposing top and bottom grooves in the top and bottom support frames respectively to receive the at least one credit card slidably therebetween;

wherein the top and bottom support frame each have two side edges and the top support frame has a groove opening downwardly along each of the two top frame side edges and the bottom support frame has an opposing mating groove opening upwardly along each of the two bottom support frame side edges forming an opposing paired set of grooves on each of the two sides, the grooves at least equal in width to the thickness of a credit card, the top and bottom surfaces spaced apart a distance so that each of the opposing paired set of grooves is capable of receiving at least one credit card along each side edge slidably inserted in and retained within the grooves, so that the credit cards form enclosing surfaces on each of the two sides of the device creating an enclosed storage space between the cards and the top and bottom frame surfaces.

2. The device of claim 1 further comprising a top flange extending downwardly from each of the side edges of the top support frame and a bottom flange extending upwardly from each of the side edges of the bottom support frame, each of the flanges positioned outside of and immediately adjacent to each groove so that the credit cards are further retained in place by each of the flanges.

3. The device of claim 1 wherein the side edges and grooves of the top and bottom support frames on at least one side are arcuate in shape to conform to an external container surface.

4. The device of claim 1 wherein the side edges and grooves of the top and bottom support frames on at least one side are concave in shape to conform to a shape of a pocket against a leg of a user.

5. The device of claim 1 wherein the side edges and grooves of the top and bottom support frames on one side are concave in shape and on the other side convex in shape of a shorter radius of curvature than the concave side so that a storage space is created between the two sides.

6. The device of claim 1 wherein the side edges and grooves of the top and bottom support frames are concave in shape on both sides creating a storage space therebetween at each end of the device.

7. The device of claim 1 wherein the side edges and grooves of the top and bottom support frames are convex in shape on both sides creating a storage space therebetween in the middle of the device.

8. The device of claim 1 wherein the rigid support comprises a rigid post at each end of the device.

9. The device of claim 1 wherein the top and bottom support frames are each formed in two pieces and the rigid support comprises a hinge between the top and bottom support frames at one end, so that one of the two pieces on each support frame pivots relative to the other.

10. The device of claim 1 wherein at least one of the support frames is provided with a notch therein and further comprising a holder means configured so that it fits in the notch and seals the notch with a tight friction fit, the holder means configured for holding a utility device, normally carried in a pocket, for insertion into and removal from the notch.

11. The device of claim 10 wherein the utility device is a key and the holder means is configured for securing the key therein.

12. The device of claim 10 wherein the utility device is a pen and the holder means is configured for securing the pen therein.

13. The device of claim 10 wherein the utility device is a knife and the holder means is configured for securing the knife therein.

14. The device of claim 1 wherein the at least one rigid support comprises one rigid support at each end of the device and each rigid support is triangular in cross-section and is positioned between the grooves on opposite sides of the device adjacent to each end of the device and the grooves on opposite sides meet at the ends of the device so that the credit cards meet at the ends to close the ends.

15. The device of claim 14 wherein each groove is the width of a single credit card adjacent to each end and gradually expanding in width to the width of two credit cards at the middle of each groove so that each groove accommodates two credit cards in each groove which overlap in the middle of the groove.

16. The device of claim 14 wherein each groove is the width of two credit cards along the entire length of the groove.

17. A credit card holder and wallet device having the enclosing sides of the device formed by a series of credit cards, wherein the device comprises:

a support frame having an elongated solid top frame and an elongated solid bottom frame spaced apart from the top frame, both formed of a solid material and both having a similar elongated configuration, the top frame having a groove opening downwardly along the length of each long edge and the bottom frame having an opposing mating groove opening upwardly along the length of each long edge forming an opposing paired set of grooves on each long side, the grooves at least equal in width to the thickness of a credit card, the top and bottom frames spaced apart a distance so that each of the opposing paired set of grooves is capable of receiving at least one credit card along each long edge slidably inserted in and retained within the grooves, so that the credit cards form enclosing surfaces on each side of the device creating an enclosed storage space between the cards and the top frame and the bottom frame;

at least one rigid support connecting the top frame and the bottom frame.

* * * * *